US011615936B2

(12) United States Patent
Subrahmanyam

(10) Patent No.: US 11,615,936 B2
(45) Date of Patent: Mar. 28, 2023

(54) CONTROLLABLE ELECTROSTATIC ION AND FLUID FLOW GENERATOR

(71) Applicant: Desaraju Subrahmanyam, Virginia Beach, VA (US)

(72) Inventor: Desaraju Subrahmanyam, Virginia Beach, VA (US)

( * ) Notice: Subject to any disclaimer, the term of this patent is extended or adjusted under 35 U.S.C. 154(b) by 299 days.

(21) Appl. No.: 17/023,905

(22) Filed: Sep. 17, 2020

(65) Prior Publication Data

US 2021/0249212 A1 Aug. 12, 2021

Related U.S. Application Data

(60) Provisional application No. 62/972,052, filed on Feb. 9, 2020.

(51) Int. Cl.
*H01J 27/20* (2006.01)

(52) U.S. Cl.
CPC ..... *H01J 27/20* (2013.01)

(58) Field of Classification Search
CPC .. H01J 37/32; H01J 27/20; H01J 27/26; H01J 23/083; H01J 23/09
See application file for complete search history.

(56) References Cited

U.S. PATENT DOCUMENTS 2,789,221 A * 4/1957 Tobias ..... H05H 13/00 313/363.1
6,504,308 B1 * 1/2003 Krichtafovitch ..... H01T 19/00 315/111.21
6,664,741 B1 * 12/2003 Krichtafovitch ..... H05H 1/48 315/111.21
7,122,070 B1 * 10/2006 Krichtafovitch ..... H01T 19/00 96/24
7,150,780 B2 * 12/2006 Krichtafovitch ..... B03C 3/47 96/95
7,157,704 B2 * 1/2007 Krichtafovitch ..... H01T 19/00 250/326
7,410,532 B2 * 8/2008 Krichtafovitch ..... H01J 49/04 96/77
7,498,588 B1 * 3/2009 Gordon ..... H05H 5/06 315/111.81
8,674,292 B2 * 3/2014 Vestal ..... H01J 49/403 250/287
11,257,665 B2 * 2/2022 Jarrold ..... H01J 49/24
11,273,465 B1 * 3/2022 Subrahmanyam ..... G10K 15/06
2004/0004440 A1 * 1/2004 Krichtafovitch ..... B03C 3/68 315/111.91
2004/0155612 A1 * 8/2004 Krichtafovitch ..... B03C 3/68 315/501

(Continued)

*Primary Examiner* — Srinivas Sathiraju

(57) ABSTRACT

One example embodiment includes one or more current-controlled electrodes exposed to a fluid and configured to generate ions in the fluid within an electric field, one or more current-controlling elements having one or more current-limiting elements configured to limit an amount of current permitted in the one or more current-controlled electrodes, and one or more current-changing elements configured to change a limit on the amount of current permitted in the one or more current-controlled electrodes, and an amount of ions generated in the fluid is based on the amount of current permitted in the one or more current-controlled electrodes as regulated by the one or more current-limiting elements and the one or more current-changing elements.

16 Claims, 8 Drawing Sheets

(56) References Cited

U.S. PATENT DOCUMENTS

2004/0183454 A1* 9/2004 Krichtafovitch ..... H05H 1/471 315/111.91
2004/0212329 A1* 10/2004 Krichtafovitch ..... B03C 3/68 315/506
2004/0217720 A1* 11/2004 Krichtafovitch ..... B03C 3/68 315/506
2005/0116166 A1* 6/2005 Krichtafovitch ..... H01T 19/00 250/324
2005/0150112 A1* 7/2005 Cafaro ..... B26B 19/3873 30/34.05
2005/0200289 A1* 9/2005 Krichtafovitch ..... H01J 49/04 315/111.91
2006/0150611 A1* 7/2006 Allen ..... H02K 44/00 60/203.1
2006/0226787 A1* 10/2006 Krichtafovitch ..... C01B 13/11 315/111.91
2007/0046219 A1* 3/2007 Krichtafovitch ..... H05H 5/00 315/506
2007/0247077 A1* 10/2007 Krichtafovitch ..... B03C 3/49 95/57
2008/0035472 A1* 2/2008 Lepage ..... A61L 9/22 204/229.8
2008/0175720 A1* 7/2008 Schlitz ..... F04D 33/00 417/48
2008/0307963 A1* 12/2008 Blum ..... B03C 3/16 95/57
2009/0155090 A1* 6/2009 Schlitz ..... F04B 19/006 165/185
2009/0321056 A1* 12/2009 Ran ..... F28F 13/02 165/104.34
2010/0052540 A1* 3/2010 Jewell-Larsen ..... H02N 11/006 250/423 R
2010/0065510 A1* 3/2010 Krichtafovitch ..... C02F 1/4608 210/243
2010/0155025 A1* 6/2010 Jewell-Larsen ..... H01L 23/467 165/96
2012/0268857 A1* 10/2012 Jewell-Larsen ..... G06F 1/203 361/231
2014/0097722 A1* 4/2014 Jewell-Larsen ..... H02N 11/006 310/300
2021/0249212 A1* 8/2021 Subrahmanyam ..... H01T 23/00
2022/0080459 A1* 3/2022 Subrahmanyam ... H04R 23/004

* cited by examiner

CONTROLLABLE ELECTROSTATIC ION AND FLUID FLOW GENERATOR

CROSS-REFERENCE TO RELATED APPLICATION

This application claims the priority to U.S. Provisional Patent Application No. 62/972,052, filed on Feb. 9, 2020 and entitled "CONTROLLABLE ELECTROSTATIC ION AND FLUID FLOW GENERATOR AND ELECTROACOUSTIC TRANSDUCER", the subject matter of this application is incorporated by reference herein in its entirety.

TECHNICAL FIELD OF THE APPLICATION

This application relates to a controllable electrostatic ion and fluid flow generator that includes electronic components that control the current in the electrostatic ion and fluid flow generator.

BACKGROUND OF THE APPLICATION

Conventional electrostatic ion and fluid flow generators, known in the art, function by producing a gas discharge, which is essentially an electrical flow (current) across a gas, turning the insulating gas into a conductor. A gas discharge is the generation of ions in a gas by applying an electric field.

An ion is an electrically charged atom or molecule where the total number of electrons is not equal to the number of protons. Therefore, the atom or molecule carries either a net positive charge or a net negative charge, and is termed either as a positive or a negative ion. An electrostatic ion and fluid flow generator may consist of a set of electrodes (i.e. one or more electrodes) exposed to the fluid, and the ionizing electric field may be produced by connecting one terminal of an external high voltage power supply to the electrode(s). The other terminal of the external high voltage power supply may be connected to the electrical earth. When the external high voltage power supply is energized, ionization may occur at the electrode(s) exposed to the fluid, and a certain number of ions may be produced. The ions may be accelerated away from the ionizing electrode(s) by their electric field, and may diffuse through the fluid; in time, they may lose their charge to the electrical earth through ambient objects in the fluid.

Alternatively, an electrostatic ion and fluid flow generator may consist of two sets of electrodes exposed to the fluid, wherein the electrode(s) of the first set are separated from the electrode(s) of the second set by an interstitial gap of fluid. An ionizing electric field may be produced between the electrode(s) of the first set and the electrode(s) of the second set by connecting the first set of electrodes to an external high voltage power supply and the second set of electrodes to the return path of the external high voltage power supply. In embodiments where the electrodes have 3D geometry, portions of the electrode(s) of the first set may overlap with portions of the electrode(s) of the second set and yet be separated from them by a gap. Ionization may occur at either set of electrodes (that is, at one or the other set, or at both) when the external high voltage power supply is energized. In operation, ion current in the fluid crosses the interstitial gap between the two sets of electrodes. The electric field between the two sets of electrodes may serve to accelerate the ions produced at either set. The return path of the external high voltage power supply may optionally be connected to the electrical earth.

Another conventional example configuration may consist of two sets of electrodes, in which the electrode(s) in the first set have a different geometry than the electrode(s) in the second set. The two sets of electrodes are exposed to the fluid, such that the electrode(s) of the first set are separated from the electrode(s) of the second set by an interstitial gap of fluid. An ionizing electric field may be produced between the electrode(s) of the first set and the electrode(s) of the second set by connecting the first set of electrodes to an external high voltage power supply and the second set of electrodes to the return path of the external high voltage power supply. Depending on the geometries of the electrodes, ionization may occur either only at the electrode(s) of the first set, or only at the electrode(s) of the second set, when the external high voltage power supply is energized. The electrode(s) at which ionization occurs may be described as 'ionizing electrode(s)'. The other electrode(s) may not originate any ions on their part but may serve to receive the ions from the ionizing electrode(s), and may be described as 'receiving electrode(s)'. The electric field between the ionizing electrodes and receiving electrodes may serve to accelerate the ions. An ionizing electrode and a receiving electrode, between which ions flow, may be described as a 'pair'. The return path of the external high voltage power supply may optionally be connected to the electrical earth.

Some conventional configurations may employ adjacent to the ionizing electrodes, a third set of electrodes, which are connected to a high voltage source and produce high intensity electric fields, either DC or AC, and serve to accelerate but not receive the ions originating from the ionizing electrodes. The electrode(s) in this third set may be described as 'accelerating electrode(s)'.

Typically, only a percentage of the molecules in the fluid may be ionized by the ionizing electrode(s), rather than all the molecules. As the produced ions are accelerated and begin to move according to the direction of the electric field, they may collide with the neutral gas molecules and transfer some of their momentum. Further, the energy of the collision may ionize the neutral gas molecule, rendering it susceptible in turn to electrostatic acceleration. A certain percentage of primary ions arising in the fluid may produce a certain percentage of secondary ionization of the nearby molecules. The total number of ions arising constitutes the 'ion current' moving between the two electrodes. A percentage of the gas molecules may acquire momentum in the direction set by the electric field, and this constitutes a fluid movement. When there is significant macroscopic (i.e. bulk) movement, a fluid flow may be said to arise. With respect to gases, this flow is often described in the art as 'ion wind'. Ion wind can produce a cooling effect depending on the velocity of the fluid molecules in the flow. Alternatively, if the ion current flowing between the electrodes is modulated, the modulating fluid movement can produce acoustic waves in the fluid.

Owing to the fact that such electrostatic ion and fluid flow generators work by accelerating ions in an electric field, they are often described in the art as electrostatic fluid accelerators (EFA).

SUMMARY OF THE APPLICATION

One example embodiment may provide an apparatus that includes one or more current-controlled electrodes exposed to a fluid and configured to generate ions in the fluid within an electric field, one or more current-controlling elements comprising one or more current-limiting elements configured to limit an amount of current permitted in the one or more current-controlled electrodes, and one or more current-changing elements configured to change a limit on the amount of current permitted in the one or more current-controlled electrodes, and an amount of ions generated in the fluid is based on the amount of current permitted in the one or more current-controlled electrodes as regulated by the one or more current-limiting elements and the one or more current-changing elements.

Another example embodiment may include an apparatus that includes one or more current-controlled electrodes exposed to a fluid and configured to receive ions in the fluid within an electric field, and one or more current-controlling elements comprising one or more current-limiting elements configured to limit an amount of current permitted in the one or more current-controlled electrodes, and one or more current-changing elements configured to change a limit on the amount of current permitted in the one or more current-controlled electrodes, and an amount of ions received in the fluid is based on the amount of current permitted in the one or more current-controlled electrodes as regulated by the one or more current-limiting elements and the one or more current-changing elements.

Another example embodiment may include a method that includes generating ions in a fluid within an electric field via one or more current-controlled electrodes exposed to the fluid, limiting an amount of current permitted in the one or more current-controlled electrodes via one or more current-limiting elements, changing a limit on the amount of current permitted in the one or more current-controlled electrodes via one or more current-changing elements, and an amount of ions generated in the fluid is based on the amount of current permitted to enter the one or more current-controlled electrodes as regulated by the one or more current-limiting elements and the one or more current-changing elements.

Still another example embodiment may include a method that includes receiving ions in a fluid within an electric field via one or more current-controlled electrodes exposed to the fluid, limiting an amount of current permitted in the one or more current-controlled electrodes via one or more current-limiting elements, and changing a limit on the amount of current permitted in the one or more current-controlled electrodes via one or more current-changing elements, and an amount of ions received in the fluid is based on the amount of current permitted to enter the one or more current-controlled electrodes as regulated by the one or more current-limiting elements and the one or more current-changing elements.

DETAILED DESCRIPTION OF THE APPLICATION

Figure 1:
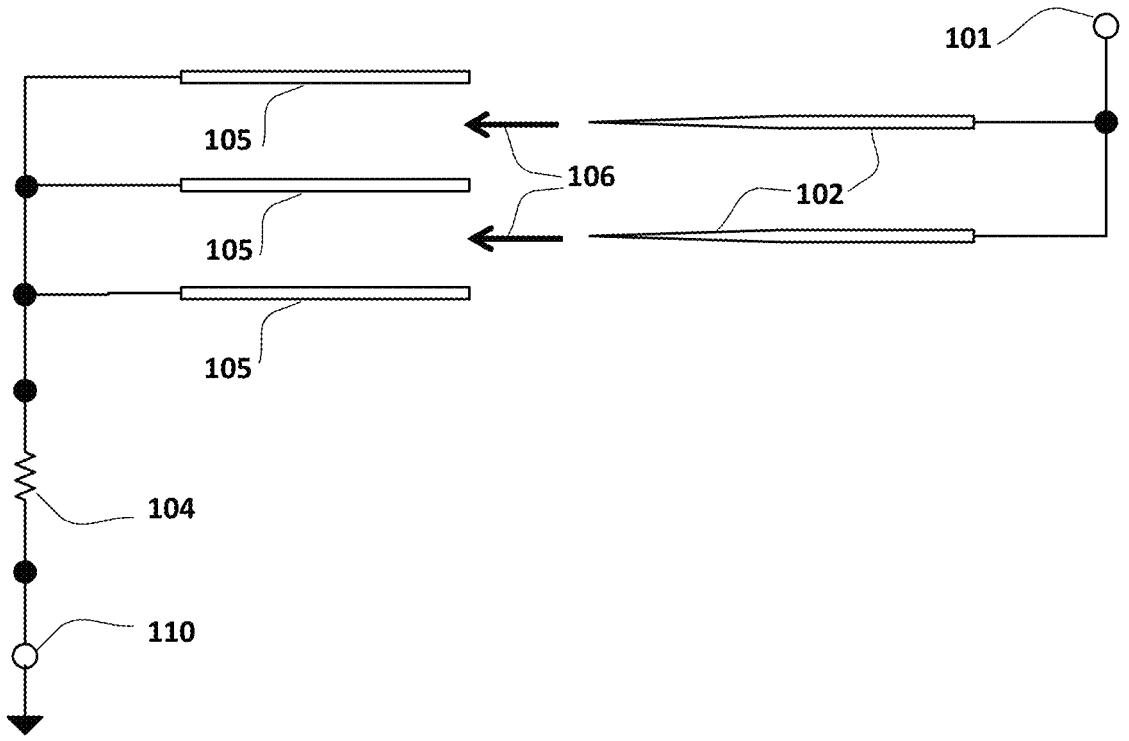
FIG. 1 (PRIOR ART)
FIG. 1 illustrates a schematic diagram of a conventional ion and fluid flow generator.

It will be readily understood that the components of the present application, as generally described and illustrated in the figures herein, may be arranged and designed in a wide variety of different configurations. Thus, the following detailed description of the embodiments of a method, apparatus, and system, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

In this disclosure, certain example configurations are described as 'electrostatic ion and fluid flow generators' to indicate that such configurations may be used in applications where (i) the generated ions perform a desired function, and the fluid movement is functionally secondary or irrelevant; (ii) the generated fluid movement performs a desired function, and the ions are functionally secondary or irrelevant; and/or (iii) both the generated ions and the fluid movement perform desired functions. Some of the applications where electrostatic ion and fluid flow generators may be used include but are not limited to: cooling of electronic devices, removing impurities from gases, propelling objects, treating surfaces, synthesizing chemicals, producing acoustic waves and dehumidifying air.

It is advantageous in many situations to control the fluid flow produced by an electrostatic ion and fluid flow generator. A case in point is a previously developed ion-wind driven airplane, which if provided with a way to control the fluid flow, may be controlled for its elevation and speed. A second example are the electrostatic ion and fluid flow generators used for cooling of electronics. If the air flow can be adjusted according to the actual heat generated in the system, then their efficiency increases compared to maintaining a steady flow matched to the maximum cooling requirement. For example, computer microprocessors produce more heat when processing heavy workloads, but computer workloads vary with time, therefore the quantity of waste heat varies with time.

It may also be optimal to control the ion current in a device that uses fluid (gas) discharge for its functional purpose. For instance, the user of ion wind for the collection and removal of particles in the air, such as air purification devices, benefit from having control over the quantity of ions generated, by producing a greater quantity of ions when the impurity particle density is higher, and a lesser quantity of ions when the impurity particle density is lower.

The ion generation and rate of fluid flow in an electrostatic ion and fluid flow generator may be controlled in several different ways. Given that the amount of ionization of a fluid, as in the case of a gas discharge, depends on the intensity of the applied electric field, the quantity of ions produced may be controlled by modulating the intensity of the applied electric field. This may be achieved either by varying the magnitude of the high voltage applied to the opposing electrodes (DC or AC) while keeping the gap between the electrodes constant, or by varying the gap between the opposing electrodes while keeping the magnitude of the applied high voltage constant. Controlling the quantity of ions produced has the effect of controlling the fluid movement. Further, given that the fluid movement is generated by accelerating the ions produced in the discharge by a high intensity electric field, the fluid movement can be controlled by modulating the high intensity electric field used for acceleration. In practice, the electric field that is used to induce the fluid (gas) discharge and the electric field that is used to accelerate the ions may be one and the same. It may also be possible to control the ion generation and rate of fluid movement by dynamically increasing and decreasing the number of ionizing electrodes that are active in the device, according to the increased/decreased requirement of ions and/or fluid flow.

According to example embodiments, the present application provides configurations which limit the current passing through the electrodes, such as in the circuit of an electrostatic ion and fluid flow generator, so as to limit the ion current produced in the fluid by the electrodes. The limited ions produced in the fluid may be accelerated by an electric field to generate a limited movement in the fluid.

By varying the limit on the current passing through the electrodes in the circuit, the ion generation and the fluid movement can be varied. By deriving the limit on the current passing through the electrodes in the circuit from an external signal, the ion generation and fluid movement can be controlled by an external signal. In the same example, by modulating the limit on the current passing through the electrodes in the circuit by using an AC signal, such as for example an audio frequency signal, pressure variations can be induced in the fluid that constitute acoustic waves.

The magnitude of the ionizing electric field, or the accelerating electric field or the inter-electrode gap may not require to be varied or modulated for the purpose of meeting the functional requirements of the device.

Embodiments of the present application may include one or more electrostatic ion and fluid flow generators, and electronic components which permit limited amounts of current to pass through, such as, for example: phototubes, photomultipliers, triodes, tetrodes, pentodes, light-dependent resistors, photo-transistors, field effect transistors, bipolar junction transistors, unijunction transistors (UJTs), Semiconductor Controlled Rectifiers (SCRs), thyristors, triacs and diacs (hereafter called 'current-limiting devices'), and associated power supplies.

Embodiments of the present application may also include electronic circuit elements or devices which serve to change current, such current-changing elements which control the current-limiting elements, may include, for example: adjustable voltage sources, light-emitting diodes, resistors, potentiometers, transformers, inductors, capacitors, field effect transistors, bipolar junction transistors, unijunction transistors (UJTs), Semiconductor Controlled Rectifiers (SCRs), thyristors, triacs and diacs, amplifiers, logic gates, digital registers (hereafter called 'current-changing devices'), and associated power supplies.

Collectively, the combination of current-limiting devices/elements, which limit the amount of current at any particular location of a circuit at any particular time, and current-changing devices/elements, which change an amount of current at any particular location of a circuit at any particular time, may be referred to hereafter as a 'current-controlling' device/element.

Embodiments of the present application may also include electronic elements or devices which serve to interface external signals to the current-controlling devices, such as for example: transformers, inductors, capacitors, resistors, potentiometers, field effect transistors, bipolar junction transistors, unijunction transistors (UJTs), Semiconductor Controlled Rectifiers (SCRs), thyristors, triacs and diacs, amplifiers, light-emitting diodes, photo-transistors, opto-couplers, logic gates, digital registers (hereafter called 'interfacing devices'), and associated power supplies.

The controllable electrostatic ion and fluid flow generators may be connected to external high voltage power supplies for generating ions and movement in the fluid, and may include at least one ionizing electrode or at least one pair of ionizing electrodes and receiving electrodes. Either or both of the ionizing and receiving electrodes may be connected to a current-controlling device or devices. The current-controlling device or devices may be connected or attached to an interfacing device or devices.

The controllable ion and fluid flow generator disclosed in this specification has the capability of being simple and efficient, and it can be constructed with very few elements, using technologically mature devices that are commercially available and relatively inexpensive, and that are easy to control. For example, RCA 919 model phototubes or 12AX7/ECC83 model triode vacuum tubes may be used with the generator. Therefore, it is reliable and easy to maintain. It is also lightweight, and where solid-state DC-DC converters are used to produce high voltage for the generator, no bulky transformers are required. Other attributes may include minimal losses in the system and the response is fast as well as highly linear, and the control range is optimal.

Many controllable ion and fluid flow generators known in the prior art vary the high voltage (e.g., kilovolts) applied to ionize the fluid and accelerate the ions, in order to vary the amount of fluid flow that is generated. But the voltage margin between the onset of electrical discharge in the fluid and electrical breakdown of the fluid (i.e., sparking) is quite narrow. Thus, there is a limited range of high voltage over which such devices can operate safely and with an optimal outcome.

The controllable ion and fluid flow generator according to example embodiments may not require any variation of the external high voltage (e.g. kilovolts) that is applied to ionize the fluid and accelerate the ions, in order to vary the amount of ions and fluid movement generated for functional purposes. The high voltage applied to the electrodes in the device may be kept essentially unvaried or unmodulated for functional purposes while the current passing through the electrodes is controlled through the current-limiting devices in the circuit. Thus, the range of control of the disclosed device is high compared to many controllable fluid flow generators known in the prior art, and this is may yield optimal results.

The following description guides those skilled in the art to construct an example embodiment of the invention, and is not intended to limit the scope, applicability, or configuration of the invention. Various modifications may be made in the geometry, function and arrangement of constituent elements without departing from the spirit and scope of the invention. In particular, it should be understood that the geometries of the electrodes as represented in the drawings, and their mutual arrangement, as well as their description below, are for illustration purposes only. They are to be regarded as examples, and are not intended to limit the geometries of the electrodes that may be used to construct the device, nor their mutual arrangement.

It should be understood that the external high voltage power sources (HVPS) referred to in the example embodiments may be either DC or AC sources, and it is the DC value or AC rms value, as the case may be, that is referred to when it is said that the magnitude of the high voltage may be kept invariant or unmodulated for the purpose of varying or modulating the ion generation or fluid flow according to functional requirements. Optionally, the return path of the external high voltage power supply may also be connected to the electrical earth (i.e., ground), such as may be available at the dedicated grounding prong of a 3-prong power plug when plugged into AC mains. If an external high voltage power source having dual polarity is used, the common terminal of the dual polarity voltage source may be connected to the electrical earth. In this application, voltage having a value of 1 kV or more, is regarded as 'high voltage', and voltage having a value of less than 1 kV is regarded as 'low voltage'.

An electrostatic ion and fluid flow generator known in the prior art is represented in FIG. 1. One or more ionizing electrodes 102 are connected to power terminal 101. One or more receiving electrodes 105 are connected to power terminal 110 either directly or through optional resistor 104 having value in the ohm or kilo-ohm range. An external HVPS (not shown) is connected at power terminal 101 and the return path of the external HVPS is connected to power terminal 110. An electric field is established between the one or more ionizing electrodes 102 and one or more receiving electrodes 105. Ions generated at ionizing electrodes 102 move towards receiving electrodes 105, originating secondary ions. Fluid movement 106 is established in the interstitial gap between the electrodes by collision of the ions with neutral molecules. Ions arriving at receiving electrodes 105 give up their charge which flows as current to power terminal 110, either directly or through optional resistor 104.

Figure 2:
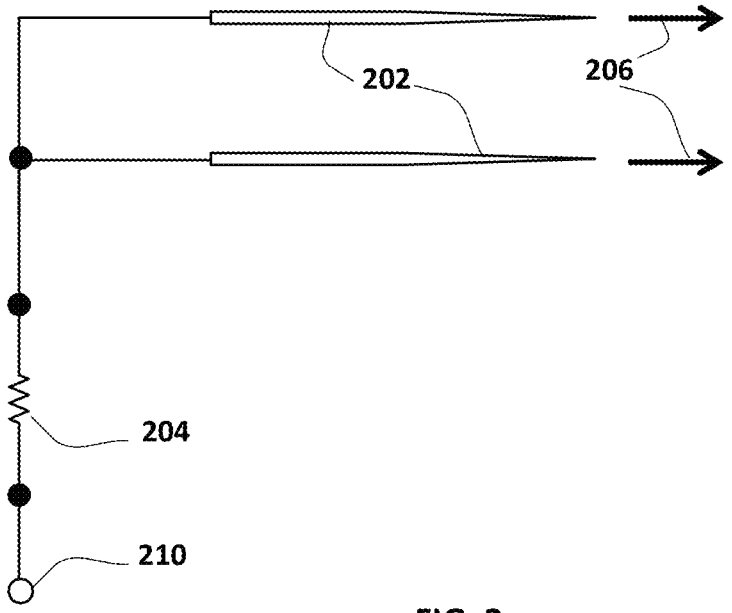
FIG. 2 (PRIOR ART)
FIG. 2 illustrates a schematic diagram of another embodiment of a conventional ion and fluid flow generator.

Another electrostatic ion and fluid flow generator known in the prior art is represented in FIG. 2. One or more ionizing electrodes 202 are connected to power terminal 210 either directly or through optional resistor 204 having value in the ohm or kilo-ohm range. One high voltage terminal of an external HVPS (not shown) is connected at power terminal 210. The other terminal of the external HVPS may be connected to the electrical earth. Ions generated at ionizing electrodes 202 may be accelerated away from the ionizing electrodes 202 by their electric field, originating secondary ions. Fluid movement 206 is established in a direction moving away from ionizing electrodes 202 by collision of the ions with neutral molecules. The ions may lose their charge to the electrical earth through ambient objects in the fluid. The example electrostatic ion and fluid flow generator represented in FIG. 2, which has ionizing electrodes but no receiving electrodes, may be used in electrostatic air purifier/dust precipitator applications.

The electrodes used in the electrostatic ion and fluid flow generator may have the geometries illustrated in FIG. 3 through FIG. 8. In particular, the receiving electrodes may have the geometries illustrated in FIG. 3 through FIG. 7, and the ionizing electrodes may have the geometry illustrated in FIG. 8.

Figure 3:
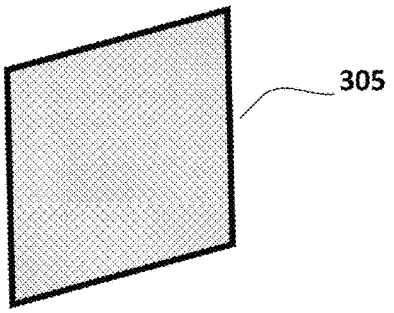
FIG. 3 illustrates a perspective view of an example geometry for a receiving electrode having a perforated flat rectangular plate.
Figure 4:
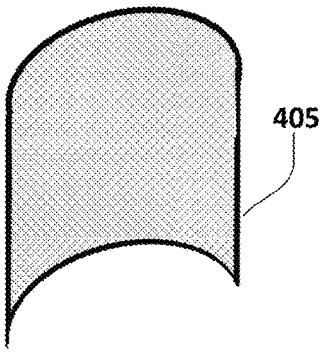
FIG. 4 illustrates a perspective view of an example geometry for a receiving electrode having a perforated hemi-cylindrical channel.
Figure 5:
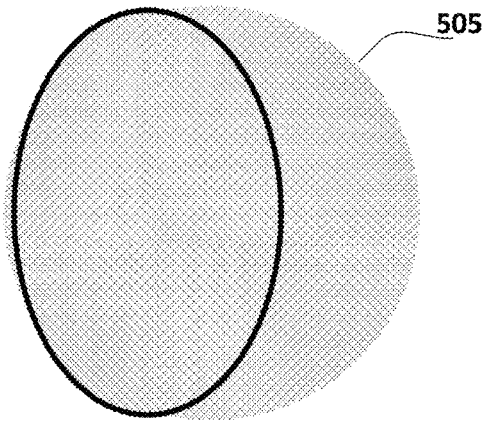
FIG. 5 illustrates a perspective view of an example geometry for a receiving electrode having a perforated hemi-spherical cup.
Figure 6:
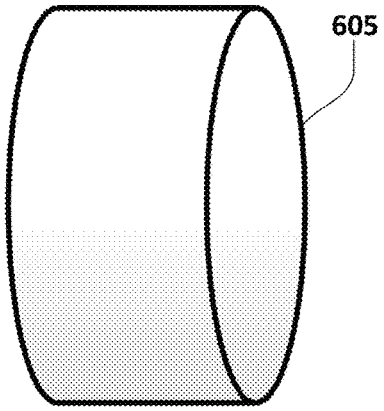
FIG. 6 illustrates a perspective view of an example geometry for a receiving electrode having a cylindrical pipe.
Figure 7:
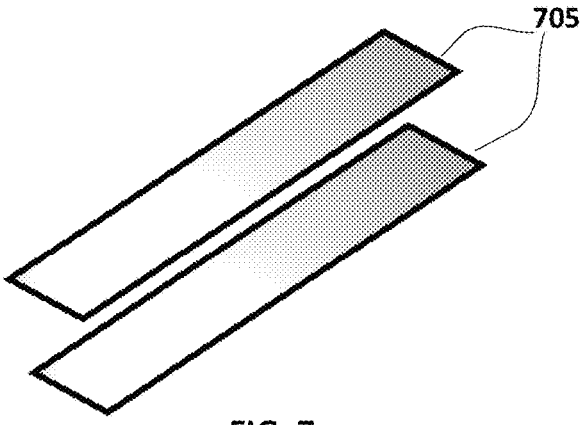
FIG. 7 illustrates a perspective view of an example geometry for a receiving electrode having a parallel plate set.
Figure 8:
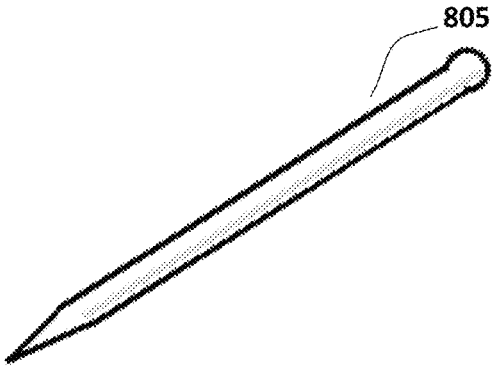
FIG. 8 illustrates a perspective view of an example geometry for an ionizing electrode having a needle shape.

In FIG. 3, receiving electrode 305 has perforated flat rectangular plate geometry, according to example embodiments. In FIG. 4, receiving electrode 405 has perforated hemi-cylindrical channel geometry, according to example embodiments. In FIG. 5, receiving electrode 505 has perforated hemi-spherical cup geometry, according to example embodiments. In FIG. 6, receiving electrode 605 has cylindrical pipe geometry, according to example embodiments. In FIG. 7, receiving electrode 705 has parallel plate set geometry, according to example embodiments. In FIG. 8, ionizing electrode 805 has needle geometry, according to example embodiments.

Figure 12:
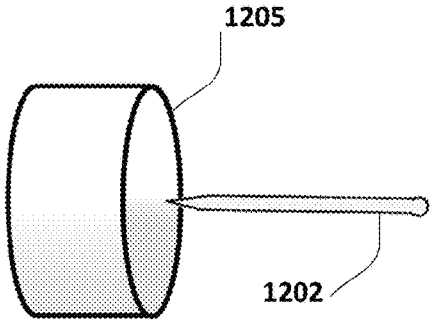
FIG. 12 illustrates a perspective view of a mutual arrangement of a receiving electrode having a cylindrical pipe geometry and an ionizing electrode having a needle geometry.
Figure 13:
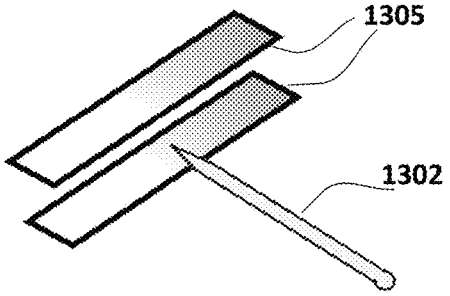
FIG. 13 illustrates a perspective view of a mutual arrangement of a receiving electrode having a parallel plate set geometry and an ionizing electrode having a needle geometry.
Figure 14:
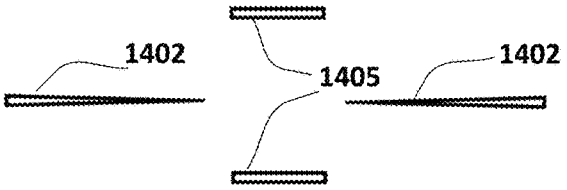
FIG. 14 illustrates an elevation view of a mutual arrangement of a receiving electrode having a parallel plate set geometry and ionizing electrodes having a needle geometry.

The ionizing and receiving electrodes used in the electrostatic fluid flow generator may have the mutual arrangements illustrated in any of FIG. 9 through FIG. 13, which are perspective views, and in FIG. 14, which is an elevation view.

Figure 9:
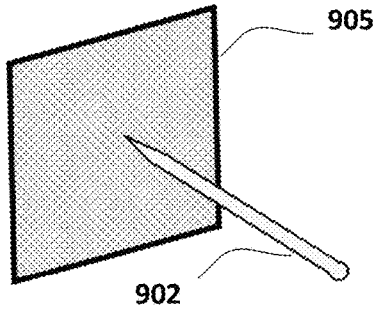
FIG. 9 illustrates a perspective view of a mutual arrangement of a receiving electrode having a perforated flat rectangular plate geometry and an ionizing electrode having a needle geometry.

In FIG. 9, the receiving electrode 905 has perforated flat rectangular plate geometry, and one or more ionizing electrodes 902 having needle geometry may be situated with their axes perpendicular to the plane of the rectangle 905, and pointing towards the surface but separated from it by a gap.

Figure 10:
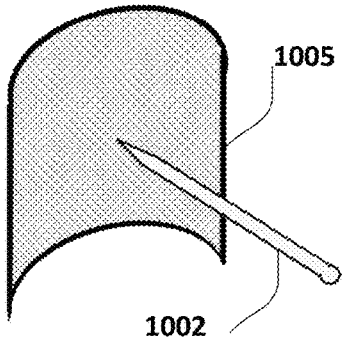
FIG. 10 illustrates a perspective view of a mutual arrangement of a receiving electrode having a perforated hemi-cylindrical channel geometry and an ionizing electrode having a needle geometry.

In FIG. 10, the receiving electrode 1005 has perforated hemi-cylindrical channel geometry, and one or more ionizing electrodes 1002 having needle geometry may be situated with their axes perpendicular to the axis of the hemi-cylinder 1005 and pointing towards the concave surface, but separated from it by a gap.

Figure 11:
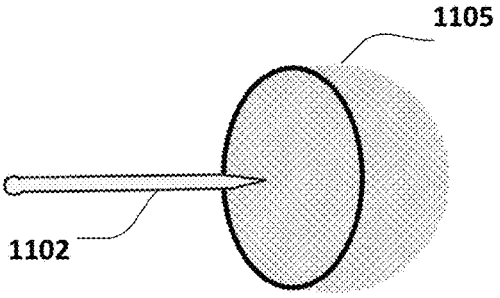
FIG. 11 illustrates a perspective view of a mutual arrangement of a receiving electrode having a perforated hemi-spherical cup geometry and an ionizing electrode having a needle geometry.

In FIG. 11, the receiving electrode 1105 has perforated hemi-spherical cup geometry, and one ionizing electrode 1102 having needle geometry may be situated with its axis perpendicular to the mouth of the hemi-spherical cup 1105 and pointing towards the concave surface, but separated from it by a gap.

In FIG. 12, the receiving electrode 1205 has cylindrical pipe geometry, and one ionizing electrode 1202 having needle geometry may be situated with its axis parallel to the axis of the cylinder and pointing towards the pipe 1205. Optionally, an additional ionizing electrode (not shown explicitly) having needle geometry may be situated on the other side of the pipe in mirror symmetry.

In FIG. 13, the receiving electrode 1305 has parallel plate set geometry, and one or more ionizing electrodes 1302 having needle geometry may be situated with their axes parallel to the planes of the parallel plates 1305 and pointing towards the gap between the plates. In FIG. 14, the receiving electrode 1405 has parallel plate set geometry, and one set of ionizing electrodes 1402 having needle geometry is situated on either side of the parallel plate set 1405, with the needles of either set pointing in the direction of the needles of the other set.

Figure 15:
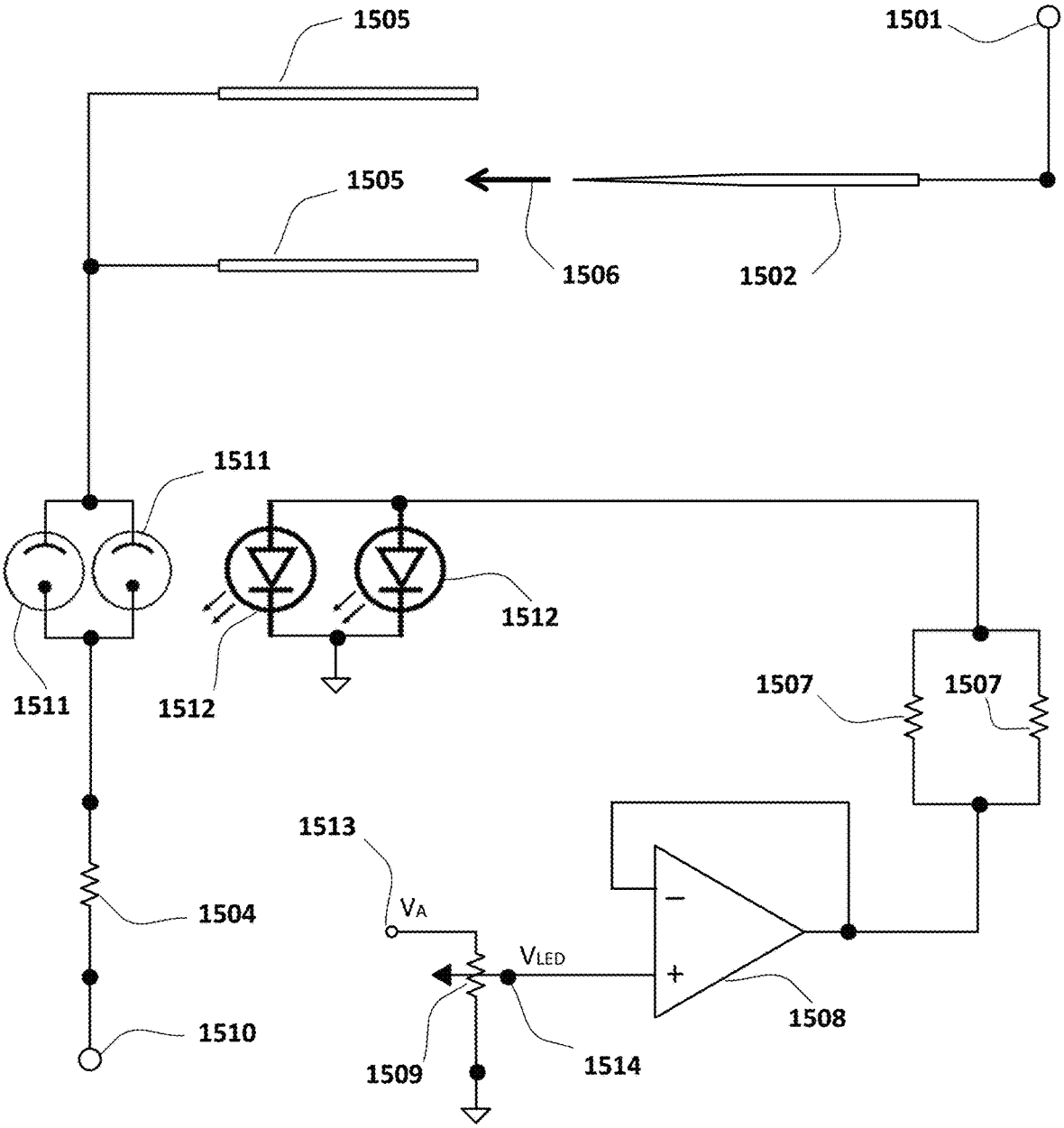
FIG. 15 illustrates a schematic diagram of a controllable ion and fluid flow generator employing phototubes as current-limiting devices according to example embodiments.
Figure 16:
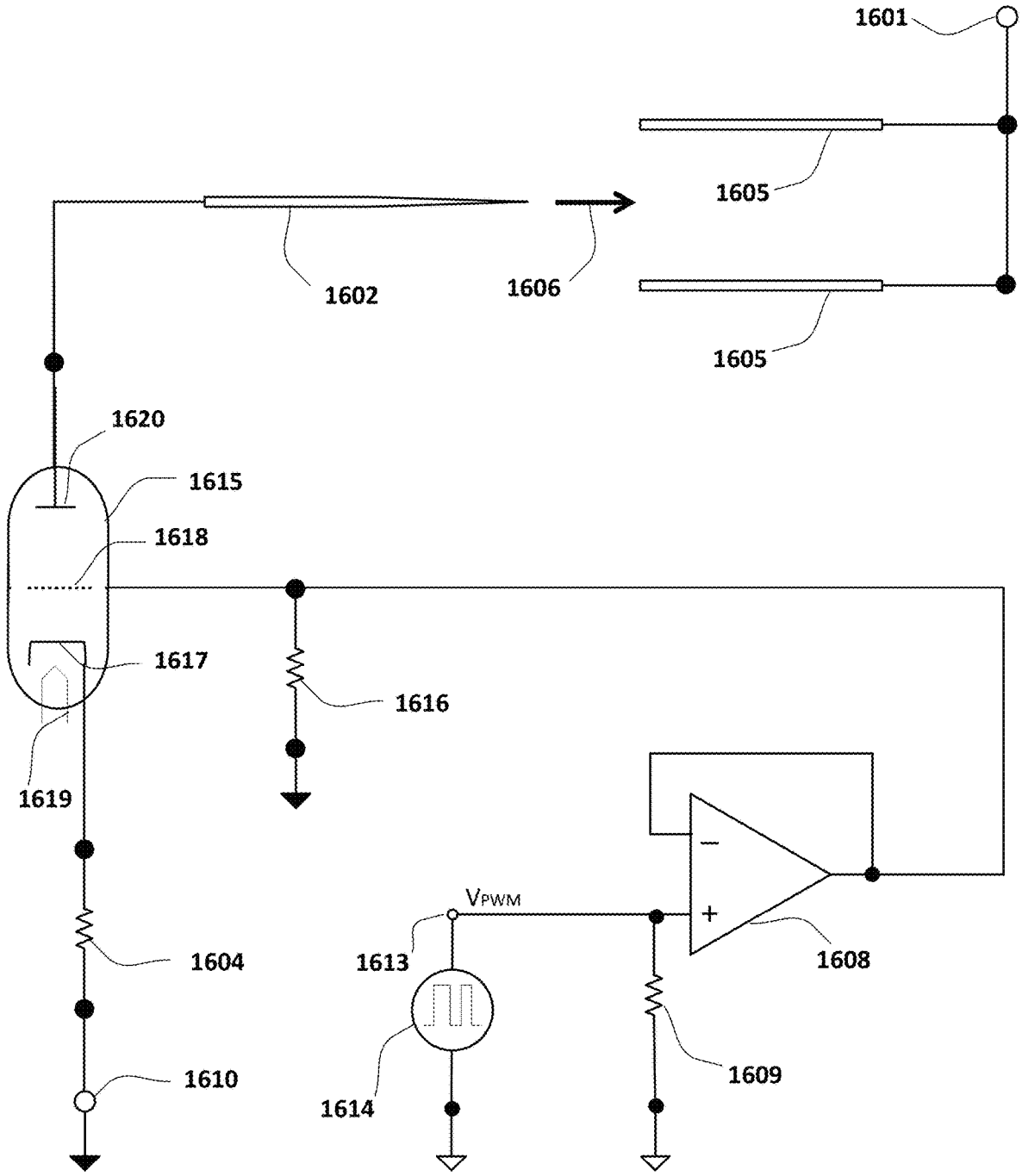
FIG. 16 illustrates a schematic diagram of a controllable ion and fluid flow generator employing vacuum tube triodes as current-limiting devices according to example embodiments.
Figure 17:
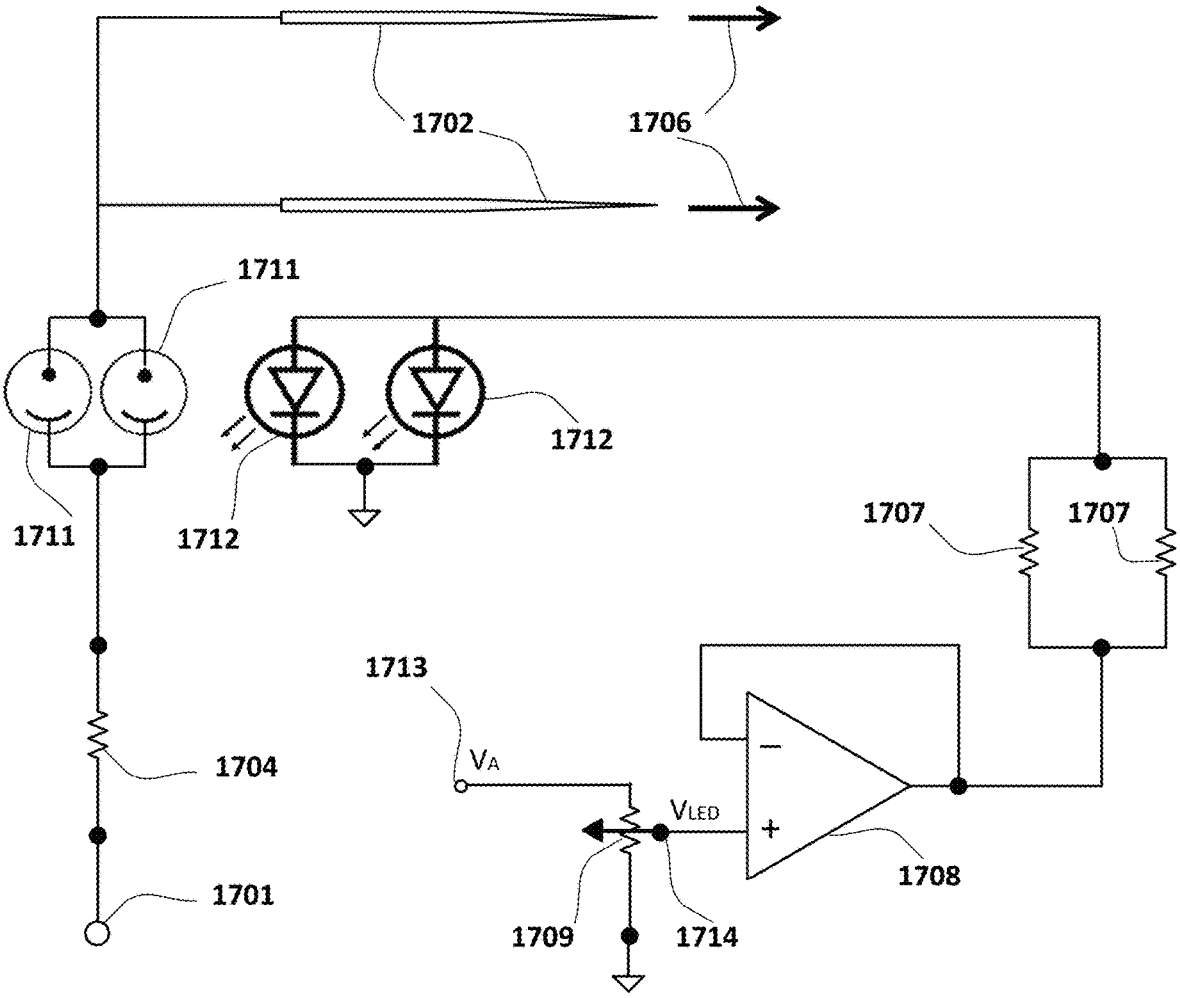
FIG. 17 illustrates another schematic diagram of a controllable ion and fluid flow generator employing phototubes as current-limiting devices according to example embodiments.

In this disclosure, the parallel plate set geometry is shown for the receiving electrodes, and the needle geometry is shown for the ionizing electrodes, in the drawings of the disclosed device configurations of FIG. 15, FIG. 16 and FIG. 17. All the electrodes are shown in elevation for example purposes. For instance, in FIG. 15, ionizing electrodes 1502 are in the form or shape of needles, while receiving electrodes 1505 are in the shape of plates.

It should be understood that the above geometries are chosen only for simplifying the illustration. The disclosed device examples require for its functioning a set of electrodes that can produce ions in the fluid, and in some example configurations, a second set of electrodes that can receive ions in the fluid. Therefore, ionizing electrodes having such geometries that ions may be produced in the fluid, and receiving electrodes having such geometries that ions may be received in the fluid, are within the scope and spirit of the invention. It should be understood therefore that the geometries of the receiving electrodes shown in FIGS. 3-7, and the geometry of the ionizing electrodes shown in FIG. 8, are intended to serve as examples only, for guiding those skilled in the art to construct the disclosed device embodiments, and are not intended to convey limitations. Similarly, it should be understood therefore that the mutual arrangements of the receiving electrodes and ionizing electrodes shown in FIGS. 9-14, are intended to serve as examples only, for guiding those skilled in the art to construct the disclosed device, and are not intended to convey limitations.

For reasons of simplicity and clarity, no accelerating electrodes are shown explicitly in the drawings of the disclosed device in FIG. 15, FIG. 16 and FIG. 17, however, an embodiment of the disclosed device may include one or more accelerating electrodes.

In all the drawings representing electronic devices powered by low voltage supplies (i.e., of voltage under 1 kV), the return path of the low voltage circuit is represented by one triangle having black outline and white interior pointing towards the bottom of the view. The return path of the high voltage circuit (i.e., of voltage great than or equal to 1 kV), is represented by one triangle having solid black color pointing towards the bottom of the view. The return path of the low voltage circuit may or may not be connected to the return path of the high voltage circuit.

An example embodiment of the disclosed controllable electrostatic ion and fluid flow generator is represented in FIG. 15. One or more ionizing electrodes 1502 are connected to power terminal 1501. One or more receiving electrodes 1505 may be connected to the cathode(s) of one or more phototubes 1511, and the anode(s) of phototube(s) 1511 may be connected to power terminal 1510 either directly or through optional resistor 1504 having value in the ohm or kilo-ohm range. An external HVPS (not shown) is connected at power terminals 1501 and 1510. An electric field is established between the ionizing electrodes 1502 and receiving electrodes 1505.

Although an electric field is established between the ionizing electrode(s) 1502 and receiving electrode(s) 1505, there may be no useful ionization at ionizing electrodes 1502, and hence no fluid movement in the device, when there is no current flowing between the anode(s) and the cathode(s) of the phototube(s) 1511. When some non-zero current flows through phototube(s) 1511, ionization may be originated at ionizing electrodes 1502, and fluid movement may be obtained in the device.

The phototubes 1511 may be placed in close proximity to light-emitting diodes 1512, within a light-tight enclosure (not shown), and may receive photons emitted from the light-emitting diodes 1512. Power amplifier 1508 energizes light-emitting diodes 1512 through one or more resistors 1507. The current in light-emitting diodes 1512, and hence their luminosity, may be set by the user by adjusting potentiometer 1509, and thereby the voltage VLED at point 1514 which is the input of power amplifier 1508. The potentiometer 1509 is energized by external low voltage source VA (not shown) applied at terminal 1513.

In response to photons received from the light-emitting diodes 1512, some non-zero current may flow between the anode(s) and the cathode(s) of phototube(s) 1511. As a result, ionization may be originated at ionizing electrodes 1502. Ions generated at ionizing electrodes 1502 move towards receiving electrodes 1505, originating secondary ions. Fluid movement 1506 is established in the interstitial gap between the electrodes by collision of the ions with neutral molecules. Ions arriving at receiving electrodes 1505 give up their charge which flows as current through phototube(s) 1511 and into power terminal 1510, either directly or through optional resistor 1504.

The phototubes 1511 act to limit the current available in the circuit to the receiving electrodes 1505; hence the ion current in the fluid is limited by the phototubes 1511 and the fluid movement is also limited. The current through the phototubes 1511 depends on the luminosity of light-emitting diodes 1512, hence the light-emitting diodes 1512 act to control the current through the phototubes 1511. By adjusting the potentiometer 1509, the user may control the luminosity of light-emitting diodes 1512, and hence the limit on the current available in the circuit to the receiving electrodes 1505, and hence rate of ionization in the fluid and/or the fluid movement.

In FIG. 15, the amplifier 1508 is energized by low voltage power supplies, which are not shown explicitly. The device configuration disclosed in FIG. 15 can work with either high voltage AC or high voltage DC applied at power terminals 1501 and 1510. In the case that high voltage AC is applied at power terminals 1501 and 1510, the ion current in the fluid may be half-wave rectified.

The embodiments represented in FIG. 15 include analog control of the current-limiting devices, however, it should be understood that digital (i.e., switching) control may be applied instead to the current-limiting devices. In one example, the variable voltage VLED applied to resistors 1507 through amplifier 1508 (see FIG. 15), may be substituted with a binary control signal such that the controllable ion and fluid flow generator may be operated at either of two levels of ion/flow generation, such as a lower level (including zero) and a higher level. Thyristors and triacs may also be used as current-controlling devices interfaced to external signals. In another example, digital modulation signals from external sources may be applied to the current-controlling devices, such as, for example, pulse width modulation (PWM), pulse density modulation (PDM) and pulse code modulation (PCM).

An example embodiment of the disclosed controllable ion and fluid flow generator that is operated by applying PWM signals from an external source is represented in FIG. 16. One or more receiving electrodes 1605 are connected to power terminal 1601. One or more ionizing electrodes 1602 may be connected to the anode(s) 1620 of one or more triode vacuum tubes 1615, and the cathode(s) 1617 of triode vacuum tubes 1615 may be connected to power terminal 1610 either directly or through optional resistor 1604 having value in the ohm or kilo-ohm range. Heaters 1619 of triode vacuum tubes 1615 may be energized by a power supply (not shown). An external HVPS (not shown) is connected at power terminal 1601 and the return path of the external HVPS is connected to power terminal 1610. An electric field is established between the ionizing electrodes 1602 and receiving electrodes 1605.

Voltage buffer 1608 provides a control voltage at low voltage to the grid(s) 1618 of triode vacuum tube(s) 1615. Resistor 1616 connects the grid(s) 1618 of triode vacuum tube(s) 1615 to the return path of the high voltage circuit. External PWM signal source 1614 may be applied at terminal 1613 on resistor 1609. Voltage buffer 1608 may buffer the signals available at terminal 1613 and apply them to grid(s) 1618 of triode vacuum tube(s) 1615. This may modulate the current flowing between anode(s) 1620 and cathode(s) 1617 of triode vacuum tube(s) 1615 according to the input PWM signal. Hence the ion current in the fluid and/or the fluid movement 1606 may be modulated according to the external PWM signal.

It should be understood that resistor 1609 and voltage buffer 1608 may serve to interface an external modulating signal to the disclosed controllable electrostatic fluid flow generator.

In FIG. 16, the voltage buffer 1608 is energized by low voltage power supplies, which are not shown explicitly. The device configuration disclosed in FIG. 16 can work with either high voltage AC or high voltage DC applied at power terminals 1601 and 1610. In the case that high voltage AC is applied at power terminals 1601 and 1610, the ion current in the fluid may be half-wave rectified. As the triode vacuum tube(s) 1615 are connected to the return path of the external HVPS either directly or through optional resistor 1604 having value in the ohm or kilo-ohm range, they may be at low potential with reference to the return path of the external HVPS.

The disclosed controllable electrostatic fluid flow generator may also be operated with analog modulation signals applied from external sources, such as, for example, audio amplifiers.

Another example embodiment of the disclosed controllable electrostatic ion and fluid flow generator is represented in FIG. 17. One or more ionizing electrodes 1702 may be connected to the anode(s) of one or more phototubes 1711, and the cathode(s) of phototube(s) 1711 may be connected to power terminal 1701, either directly or through optional resistor 1704 having value in the ohm or kilo-ohm range. One terminal of an external HVPS (not shown) may be connected at power terminal 1701, for energizing the example device. The other terminal of the external HVPS (not shown) may be connected to the electrical earth. An electric field arises at ionizing electrodes 1702.

Although an electric field arises at the ionizing electrode (s) 1702, there may be no useful ionization at ionizing electrodes 1702, and hence no fluid movement in the device, when there is no current flowing between the anode(s) and the cathode(s) of the phototube(s) 1711. When some non-zero current flows through phototube(s) 1711, ionization may be originated at ionizing electrodes 1702, and fluid movement may be obtained in the device.

The phototube(s) 1711 may be placed in close proximity to light-emitting diodes 1712, within a light-tight enclosure (not shown), and may receive photons emitted from the light-emitting diodes 1712. Power amplifier 1708 energizes light-emitting diodes 1712 through one or more resistors 1707. The current in light-emitting diodes 1712, and hence their luminosity, may be set by the user by adjusting potentiometer 1709, and thereby the voltage VLED at point 1714 which is the input of power amplifier 1708. The potentiometer 1709 is energized by external low voltage source VA (not shown) applied at terminal 1713.

In response to photons received from the light-emitting diodes 1712, some non-zero current may flow between the anode(s) and the cathode(s) of phototube(s) 1711. As a result, ionization may be originated at ionizing electrodes 1702. Ions generated at ionizing electrodes 1702 may be accelerated away from the ionizing electrodes 1702 by their electric field, originating secondary ions. Fluid movement 1706 is established in a direction moving away from ionizing electrodes 1702 by collision of the ions with neutral molecules. The ions may lose their charge to the electrical earth through ambient objects in the fluid.

The phototubes 1711 act to limit the current available in the circuit to the ionizing electrodes 1702; hence the ion current in the fluid is limited by the phototubes 1711 and the fluid movement is also limited. The current through the phototubes 1711 depends on the luminosity of light-emitting diodes 1712, hence the light-emitting diodes 1712 act to control the current through the phototubes 1711. By adjusting the potentiometer 1709, the user may control the luminosity of light-emitting diodes 1712, and hence the limit on the current available in the circuit to the ionizing electrodes 1702, and hence rate of ionization in the fluid and/or the fluid flow.

In FIG. 17, the amplifier 1708 is energized by low voltage power supplies, which are not shown explicitly. The device configuration disclosed in FIG. 17 can work with either high voltage AC or high voltage DC applied at terminal 1710. In the case that high voltage AC is applied at terminal 1710, the ion current in the fluid may be half-wave rectified.

The embodiment represented in FIG. 17 may be implemented using general purpose phototubes such as RCA 919, though they are not rated for high voltage operation as such. The bodies of the current-controlling light emitting diodes used in the implementation may be electrically earthed to protect them from the high voltage on the RCA 919 phototubes that are in close proximity.

It should be understood that a few ionizing and receiving electrodes are represented in the drawings of this disclosure for the sake of simplicity and clarity, no limitation is intended for the number of either ionizing or receiving electrodes in the example embodiments. Similarly, a few current-limiting devices, current-controlling devices and interfacing devices and elements are represented in the drawings for the sake of simplicity and clarity, no limitation is intended for the number of current-limiting devices, current-controlling devices or interfacing devices in the example embodiments. It should also be understood that one ionizing (or receiving) electrode may be connected to one or more current-limiting devices, or that two or more ionizing (or receiving) electrodes may be connected to one common current-limiting device, or that two or more ionizing (or receiving) electrodes may be connected to two or more current-limiting devices in common or any combination of the examples included in the disclosure.

Figure 18:
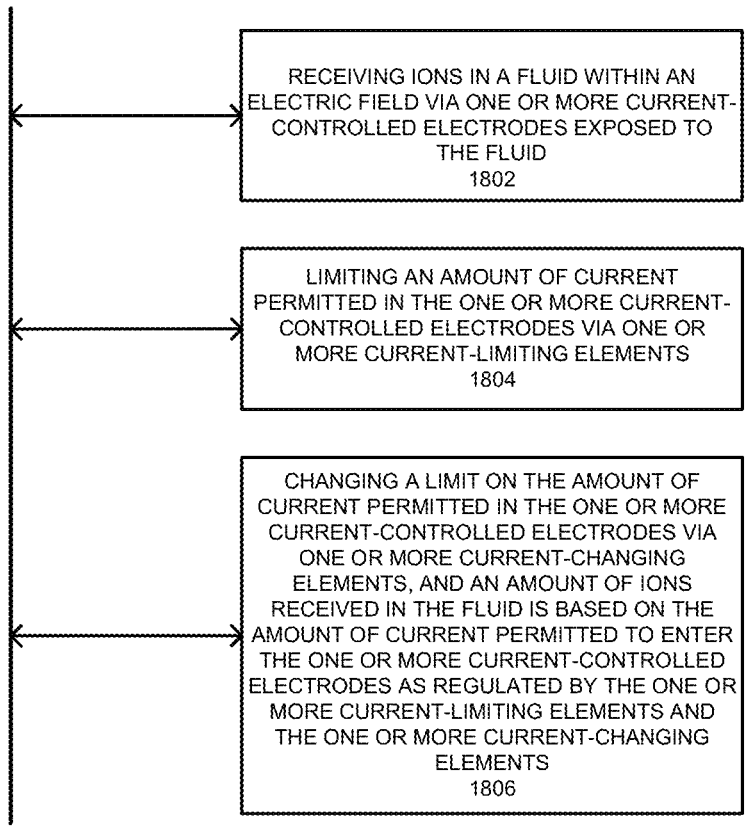
FIG. 18 illustrates a flow diagram of an example process according to example embodiments.

FIG. 18 illustrates a flow diagram of an example process according to example embodiments. Referring to FIG. 18, the example flow process 1800 includes receiving ions in a fluid within an electric field via one or more current-controlled electrodes exposed to the fluid 1802, limiting an amount of current permitted in the one or more current-controlled electrodes via one or more current-limiting elements 1804, and changing a limit on the amount of current permitted in the one or more current-controlled electrodes via one or more current-changing elements, and an amount of ions received in the fluid is based on the amount of current permitted to enter the one or more current-controlled electrodes as regulated by the one or more current-limiting elements and the one or more current-changing elements 1806.

The process may also include generating ions in the fluid within an electric field via one or more ancillary electrodes disposed opposite to or overlapping with the one or more current-controlled electrodes and separated from the one or more current-controlled electrodes by an interstitial gap of fluid, limiting an amount of current permitted in the one or more ancillary electrodes via one or more additional current-limiting elements, changing a limit on the amount of current permitted in the one or more ancillary electrodes via one or more additional current-changing elements and the one or more ancillary electrodes operate as a current-controlled element, and an amount of ions generated in the fluid within an electric field is based on the amount of current permitted to enter the one or more ancillary electrodes as regulated by the one or more additional current-limiting elements and the one or more additional current-changing elements.

Figure 19:
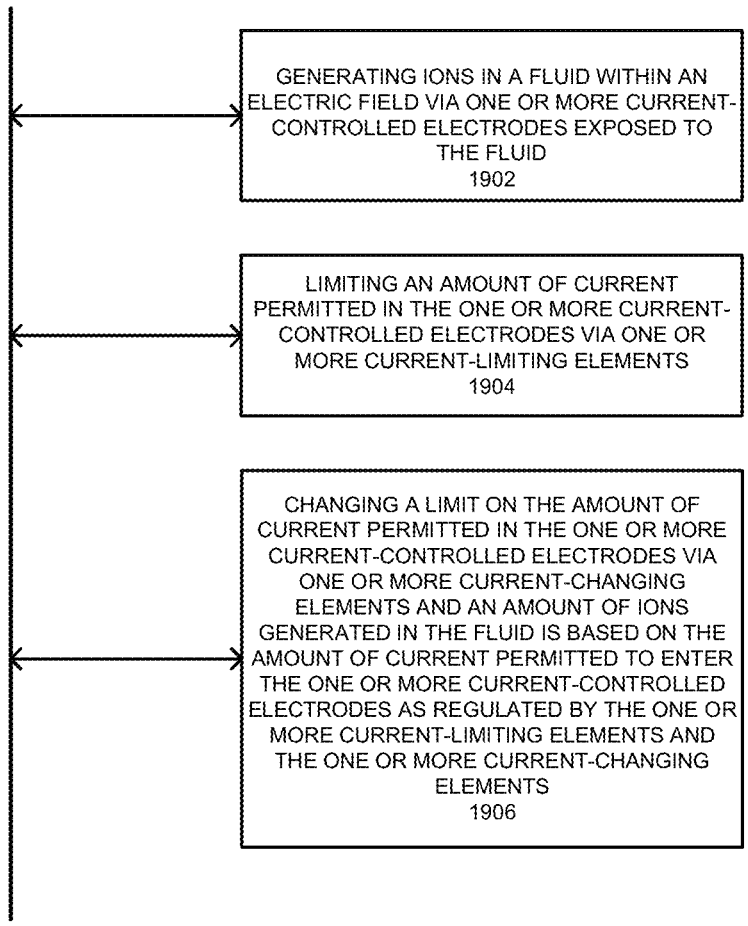
FIG. 19 illustrates another flow diagram of an example process according to example embodiments.

FIG. 19 illustrates another flow diagram of an example process according to example embodiments. Referring to FIG. 19, the method 1900 includes generating ions in a fluid within an electric field via one or more current-controlled electrodes exposed to the fluid 1902, limiting an amount of current permitted in the one or more current-controlled electrodes via one or more current-limiting elements 1904, and changing a limit on the amount of current permitted in the one or more current-controlled electrodes via one or more current-changing elements, and an amount of ions generated in the fluid is based on the amount of current permitted to enter the one or more current-controlled electrodes as regulated by the one or more current-limiting elements and the one or more current-changing elements 1906.

The process may also include receiving the ions generated in the fluid within an electric field via one or more ancillary electrodes disposed opposite to or overlapping with the one or more current-controlled electrodes and separated from the one or more current-controlled electrodes by an interstitial gap of fluid, limiting an amount of current permitted in the one or more ancillary electrodes via one or more additional current-limiting elements, changing a limit on the amount of current permitted in the one or more ancillary electrodes via one or more additional current-changing elements and the one or more ancillary electrodes operate as a current-controlled element, and an amount of ions received in the fluid within an electric field is based on the amount of current permitted to enter the one or more ancillary electrodes as regulated by the one or more additional current-limiting elements and the one or more additional current-changing elements.

According to example embodiments, certain use cases may include energizing the ionizing electrodes and permitting the ions to float through the fluid with no receiving electrodes provided in the device. The current supplied to the ionizing electrodes may be controlled to throttle the amount of ions.

In another use case, either the ionizing electrodes or the receiving electrodes may be attached to current-controlling devices. The combination creates a controllable electrostatic ion and fluid flow generator.

In still another use case, both the ionizing electrodes and receiving electrodes may be attached to respective current-controlling devices. The combination creates a controllable electrostatic ion and fluid flow generator, and it can be operated by controlling the current at either side of the fluid flow generator or at both sides.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the application as discussed above may be practiced with steps in a different order, and/or with hardware elements in configurations that are different than those which are disclosed. Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

While preferred embodiments of the present application have been described, it is to be understood that the embodiments described are illustrative only and the scope of the application is to be defined solely by the appended claims when considered with a full range of equivalents and modifications (e.g., hardware devices, electrical circuits, protocols, software platforms etc.) thereto.

What is claimed is:

1. An apparatus comprising one or more ionizing electrodes and one or more receiving electrodes exposed to a fluid and configured to generate ions in the fluid within an electric field, wherein the one or more ionizing electrodes operate as current-limited electrodes; and one or more current-limiting devices operating at less than one kilovolt and connected in series circuit with the one or more ionizing electrodes;

wherein the current-limiting devices comprise one or more of a phototube, photomultiplier, triode, transistor and thyristor;

wherein a current in the one or more ionizing electrodes passes through the one or more current-limiting devices;

wherein the current-limiting devices limit the current in the one or more ionizing electrodes;

wherein the limit on the current in the one or more ionizing electrodes limits an amount of ions generated in the fluid.

2. The apparatus of claim 1, further comprising:

one or more additional current-limiting devices connected in series circuit with the one or more receiving electrodes;

wherein each of the one or more ancillary receiving electrodes operate as a current controlled element current-limited electrode;

wherein the additional current-limiting devices comprise one or more of a phototube, photomultiplier, triode, transistor and thyristor;

wherein a current in the one or more receiving electrodes passes through the one or more additional current limiting devices;

wherein the additional current-limiting devices limit the current in the one or more receiving electrodes;

wherein the limit on the current in the one or more receiving electrodes limits an amount of ions received in the fluid.

3. The apparatus of claim 2, further comprising:

one or more additional current-changing devices which operate with the one or more additional current-limiting devices and change the limit on the current in the one or more additional current-limiting devices; and one or more additional interfacing devices through which an additional variable electrical signal of less than one kilovolt is provided as an input to the one or more additional current-changing devices;

wherein the additional variable electrical signal comprises one or more of an external variable electrical signal, modulating electrical signal and alternating current (AC) electrical signal;

wherein the amount of current in the one or more receiving electrodes is controlled by the additional variable electrical signal via the one or more additional current-changing devices and the one or more additional current-limiting devices while the electric field is kept constant.

4. The apparatus of claim 1, further comprising:

one or more current-changing devices which operate at the low voltage less than one kilovolt with the one or more current-limiting devices and change the limit on the current in the one or more current-limiting devices; and one or more interfacing devices through which a variable electrical signal of less than one kilovolt is provided as an input to the one or more current-changing devices;

wherein the variable electrical signal comprises one or more of an external variable electrical signal, modulating electrical signal and alternating current (AC) electrical signal;

wherein the amount of current in the one or more ionizing electrodes is controlled by the variable electrical signal via the one or more current-changing devices and the one or more current-limiting devices while the electric field is kept constant.

5. An apparatus comprising:

one or more ionizing electrodes and one or more receiving electrodes exposed to a fluid and configured to generate ions in the fluid within an electric field, wherein the one or more receiving electrodes operate as current-controlled electrodes; and one or more current-limiting devices operating at less than one kilovolt and connected in series circuit with the one or more receiving electrodes;

wherein the current-limiting devices comprise one or more of a phototube, photomultiplier, triode, transistor and thyristor;

wherein a current in the one or more receiving electrodes passes through the one or more current-limiting devices;

wherein the current-limiting devices limit the current in the one or more receiving electrodes;

wherein the limit on the current in the one or more receiving electrodes limits an amount of ions received in the fluid.

6. The apparatus of claim 5, further comprising:

one or more additional current-limiting devices connected in series circuit with the one or more ionizing electrodes;

wherein each of the one or more ionizing electrodes operate as a current-controlled electrode;

wherein the additional current-limiting devices comprise one or more of a phototube, photomultiplier, triode, transistor and thyristor;

wherein a current in the one or more ionizing electrodes passes through the one or more additional current limiting devices;

wherein the additional current-limiting devices limit the current in the one or more ionizing electrodes;

wherein the limit on the current in the one or more ionizing electrodes limits an amount of ions generated in the fluid;.

7. The apparatus of claim 6, further comprising:

one or more additional current-changing devices which operate with the one or more additional current-limiting devices and change the limit on the current in the one or more additional current-limiting devices; and one or more additional interfacing devices through which an additional variable electrical signal of less than one kilovolt is provided as an input to the one or more additional current-changing devices;

wherein the additional variable electrical signal comprises one or more of an external variable electrical signal, modulating electrical signal and alternating current (AC) electrical signal;

wherein the amount of current in the one or more ionizing electrodes is controlled by the additional variable electrical signal via the one or more additional current-changing devices and the one or more additional current-limiting devices.

8. The apparatus of claim 5, further comprising:

one or more current-changing devices which operate at the low voltage less than one kilovolt with the one or more current-limiting devices and change the limit on the current in the one or more current-limiting devices; and one or more interfacing devices through which a variable electrical signal of less than one kilovolt is provided as an input to the one or more current-changing devices;

wherein the variable electrical signal comprises one or more of an external variable electrical signal, modulating electrical signal and alternating current (AC) electrical signal;

wherein the amount of current in the one or more receiving electrodes is controlled by the variable electrical signal via the one or more current-changing devices and the one or more current-limiting devices while the electric field is kept constant.

9. A method comprising:

generating ions in a fluid within an electric field via one or more ionizing electrodes and one or more receiving electrodes exposed to the fluid, wherein the one or more ionizing electrodes operate as current-limited electrodes; and limiting an amount of current in the one or more ionizing electrodes via one or more current-limiting devices operating at less than one kilovolt and connected in series circuit with the one or more ionizing electrodes;

wherein the current-limiting devices comprise one or more of a phototube, photomultiplier, triode, transistor and thyristor;

wherein a current in the one or more ionizing electrodes passes through the one or more current-limiting devices;

wherein the current-limiting devices limit the current in the one or more ionizing electrodes;

wherein the limit on the current in the one or more ionizing electrodes limits an amount of ions generated in the fluid.

10. The method of claim 9, further comprising limiting an amount of current in the one or more receiving electrodes via one or more additional current-limiting devices connected in series circuit with the one or more receiving electrodes;

wherein each of the one or more additional current-limiting devices comprise one or more of a phototube, photomultiplier, triode, transistor and thyristor;

wherein each of the one or more receiving electrodes operate as a current-limited electrode;

wherein a current in the one or more receiving electrodes passes through the one or more additional current limiting devices;

wherein the current-limiting devices limit the current in the one or more receiving electrodes;

wherein the limit on the current in the one or more receiving electrodes limits an amount of ions received in the fluid.

11. The method of claim 10, further comprising:

changing the limit on the current in the one or more additional current-limiting devices via one or more additional current-changing devices; and providing an additional variable electrical signal of less than one kilovolt as an input to the one or more additional current-changing devices via one or more additional interfacing devices;

wherein the additional variable electrical signal comprises one or more of an external variable electrical signal, modulating electrical signal and alternating current (AC) electrical signal;

wherein the amount of current in the one or more receiving electrodes is controlled by the additional variable electrical signal via the one or more additional current-changing devices and the one or more additional current-limiting devices while the electric field is kept constant.

12. The method of claim 9, further comprising:

changing the limit on the current in the one or more current-limiting devices via one or more current-changing devices operating at the low voltage less than one kilovolt; and providing a variable electrical signal of less than one kilovolt as an input to the one or more current-changing devices via one or more interfacing devices;

wherein the variable electrical signal comprises one or more of an external variable electrical signal, modulating electrical signal and alternating current (AC) electrical signal;

wherein the amount of current in the one or more ionizing electrodes is controlled by the variable electrical signal via the one or more current-changing devices and the one or more current-limiting devices while the electric field is kept constant.

13. A method comprising:

generating ions in a fluid within an electric field via one or more ionizing electrodes and one or more receiving electrodes exposed to the fluid, wherein the one or more receiving electrodes operate as current-limited electrodes; and limiting an amount of current in the one or more receiving electrodes via one or more current-limiting devices operating at less than one kilovolt and connected in series circuit with the one or more receiving electrodes;

wherein the current-limiting devices comprise one or more of a phototube, photomultiplier, triode, transistor and thyristor;

wherein a current in the one or more receiving electrodes passes through the one or more current-limiting devices;

wherein the current-limiting devices limit the current in the one or more receiving electrodes;

wherein the limit on the current in the one or more receiving electrodes limits an amount of ions received in the fluid.

14. The method of claim 13, further comprising limiting an amount of current in the one or more ionizing electrodes via one or more additional current-limiting devices connected in series with the one or more ionizing electrodes;

wherein each of the one or more additional current-limiting devices comprise one or more of a phototube, photomultiplier, triode, transistor and thyristor;

wherein a current in the one or more ionizing electrodes passes through the one or more additional current-limiting devices;

wherein each of the one or more ionizing electrodes operate as a current-limited electrode;

wherein the additional current-limiting devices limit the current in the one or more ionizing electrodes;

wherein the limit on the current in the one or more ionizing electrodes limits an amount of ions generated in the fluid.

15. The method of claim 14, further comprising:

changing the limit on the current in the one or more additional current-limiting devices via one or more additional current-changing devices; and providing an additional variable electrical signal of less than one kilovolt as an input to the one or more additional current-changing devices via one or more additional interfacing devices;

wherein the additional variable electrical signal comprises one or more of an external variable electrical signal, modulating electrical signal and alternating current (AC) electrical signal;

wherein the amount of current in the one or more ionizing electrodes is controlled by the additional variable electrical signal via the one or more additional current-changing devices and the one or more additional current-limiting devices while the electric field is kept constant.

16. The method of claim 13, further comprising:

changing the limit on the current in the one or more current-limiting devices via one or more current-changing devices operating at the low voltage less than one kilovolt; and providing a variable electrical signal of less than one kilovolt as an input to the one or more current-changing devices via one or more interfacing devices;

wherein the variable electrical signal comprises one or more of an external variable electrical signal, modulating electrical signal and alternating current (AC) electrical signal;

wherein the amount of current in the one or more receiving electrodes is controlled by the variable electrical signal via the one or more current-changing devices and the one or more current-limiting devices while the electric field is kept constant.

* * * * *